US008276566B2

(12) United States Patent
Horstmann et al.

(10) Patent No.: US 8,276,566 B2
(45) Date of Patent: Oct. 2, 2012

(54) METHOD FOR OPERATING A FUEL INJECTION SYSTEM OF A MOTOR VEHICLE IN PARTICULAR

(75) Inventors: Peter Horstmann, Sindelfingen (DE); Stefan Keller, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 1417 days.

(21) Appl. No.: 11/665,167

(22) PCT Filed: Aug. 18, 2005

(86) PCT No.: PCT/EP2005/054071

§ 371 (c)(1), (2), (4) Date: Sep. 13, 2007

(87) PCT Pub. No.: WO2006/040212

PCT Pub. Date: Apr. 20, 2006

(65) Prior Publication Data

US 2011/0126807 A1 Jun. 2, 2011

(30) Foreign Application Priority Data

Oct. 12, 2004 (DE) ..... 10 2004 049 812

(51) Int. Cl.
*F02M 63/00* (2006.01)

(52) U.S. Cl. ..... 123/458; 123/486; 123/511

(58) Field of Classification Search ..... 123/456–458, 123/486, 511

See application file for complete search history.

(56) References Cited

U.S. PATENT DOCUMENTS

| | | | | |
|---|---|---|---|---|
| 6,497,223 | B1 * | 12/2002 | Tuken et al. | 123/497 |
| 6,581,574 | B1 * | 6/2003 | Moran et al. | 123/497 |
| 6,609,500 | B2 * | 8/2003 | Ricco et al. | 123/446 |
| 7,066,149 | B1 * | 6/2006 | Date et al. | 123/457 |
| 7,077,107 | B2 * | 7/2006 | Boos et al. | 123/446 |
| 7,302,935 | B2 * | 12/2007 | Achleitner et al. | 123/446 |
| 7,503,313 | B2 * | 3/2009 | Achleitner et al. | 123/446 |
| 7,886,720 | B2 * | 2/2011 | Graf | 123/497 |

FOREIGN PATENT DOCUMENTS

| | | |
|---|---|---|
| DE | 100 44 412 | 3/2002 |
| DE | 10044412 | 3/2002 |
| DE | 10 62 989 | 10/2003 |
| DE | 10162989 | 10/2003 |
| EP | 0 735 260 | 10/1996 |
| EP | 0735260 | 10/1996 |
| JP | 5 163994 | 8/1993 |
| JP | 2001289099 | 10/2001 |
| JP | 2002-71640 | 3/2002 |
| JP | 2003-343709 | 12/2003 |

* cited by examiner

*Primary Examiner* — Erick Solis
(74) *Attorney, Agent, or Firm* — Kenyon & Kenyon LLP

(57) ABSTRACT

A method for operating a fuel injection system of a motor vehicle in particular is described. The fuel injection system has a fuel accumulator, capable of receiving fuel via a metering unit. In the method, an actual pressure in the fuel accumulator is affected by an I regulator, among other things. A precontrol value is generated by a precontrol characteristic map, which is used for compensating manufacturing-related differences in the components of the fuel injection system.

9 Claims, 2 Drawing Sheets

METHOD FOR OPERATING A FUEL INJECTION SYSTEM OF A MOTOR VEHICLE IN PARTICULAR

FIELD OF THE INVENTION

The present invention is based on a method for operating a fuel injection system of a motor vehicle in particular. The present invention also relates to a corresponding computer program, a corresponding electric memory, a corresponding control unit, and a corresponding fuel injection system for a motor vehicle in particular.

BACKGROUND INFORMATION

A fuel accumulator which receives fuel via a metering unit and a high-pressure pump is provided in known fuel injection systems. Influencing the actual pressure in the fuel accumulator with the aid of an I regulator, for example, is also known.

It is also known that manufacturing-related variances may exist between different fuel injection systems. Such variances may be compensated by the I regulator alone. The I regulator has a rather high inertia due to its time constant, so that, for example, in the event of a change in the operating point of the fuel injection system, possibly existing manufacturing-related differences may only be compensated slowly. This reduces the accuracy and thus the correctness of the quantity injected by the fuel injection system.

SUMMARY OF THE INVENTION

The object of the present invention is to provide a method for operating a fuel injection system, via which the accurate injection of the correct injection quantity is ensured even in the event of a change in the operating point of the fuel injection system.

According to the present invention, a precontrol value is generated by a precontrol characteristic map, via which manufacturing-related differences of components of the fuel injection system are compensated. The variance of different fuel injection systems is thus not compensated by the I regulator, but by the additional precontrol characteristic map according to the present invention.

An adaptive precontrol is thus implemented with the aid of the present invention.

This offers the important advantage that, in the event of a change in the operating point of the fuel injection system, the precontrol value associated with the new operating point may be ultimately read from the precontrol characteristic map without a time delay. Any manufacturing-related differences that may be present may thus be taken into account immediately at the new operating point of the fuel injection system via the read-out precontrol value. There is thus no more time delay due to a time constant of an I regulator or the like.

By thus taking a manufacturing-related variance of components of the fuel injection system immediately into account, the accuracy and thus the correctness of the injected fuel quantity is considerably improved. This results, at the same time, in reduced fuel consumption and reduced emission of pollutants.

In an advantageous refinement of the present invention, the values of the precontrol characteristic map are ascertained during operation of the fuel injection system and entered one by one into the characteristic map. This ultimately represents a learning process of the precontrol characteristic map. The advantage that manufacturing-related differences between different fuel injection systems are automatically taken into account is achieved in this way. Therefore, these differences do not have to be detected separately, for example, before putting the fuel injection system in service. The method according to the present invention may therefore be used in a simple and cost-effective way.

In an advantageous embodiment of the present invention, the output value of the I regulator is entered into the precontrol characteristic map at one operating point of the fuel injection system. This represents the learning process of the precontrol characteristic map.

The output value of the I regulator is advantageously distributed to a plurality of sampling points of the precontrol characteristic map.

In an advantageous refinement of the present invention, the appropriate precontrol value is read from the precontrol characteristic map for the instantaneous operating point during operation of the fuel injection system. The precontrol value required for compensating the manufacturing-related differences is thus immediately available. Therefore, the manufacturing-related differences no longer have to be compensated with the aid of the I regulator.

BRIEF DESCRIPTION OF THE DRAWINGS

Additional features, possible applications, and advantages of the present invention are derived from the subsequent description of exemplary embodiments of the present invention and are illustrated in the figures of the drawing. All features described or illustrated by themselves or in any desired combination represent the object of the present invention, regardless of their combination in the patent claims or their back-references, and regardless of their wording in the description or illustration in the drawing.

DETAILED DESCRIPTION

Figure 1:
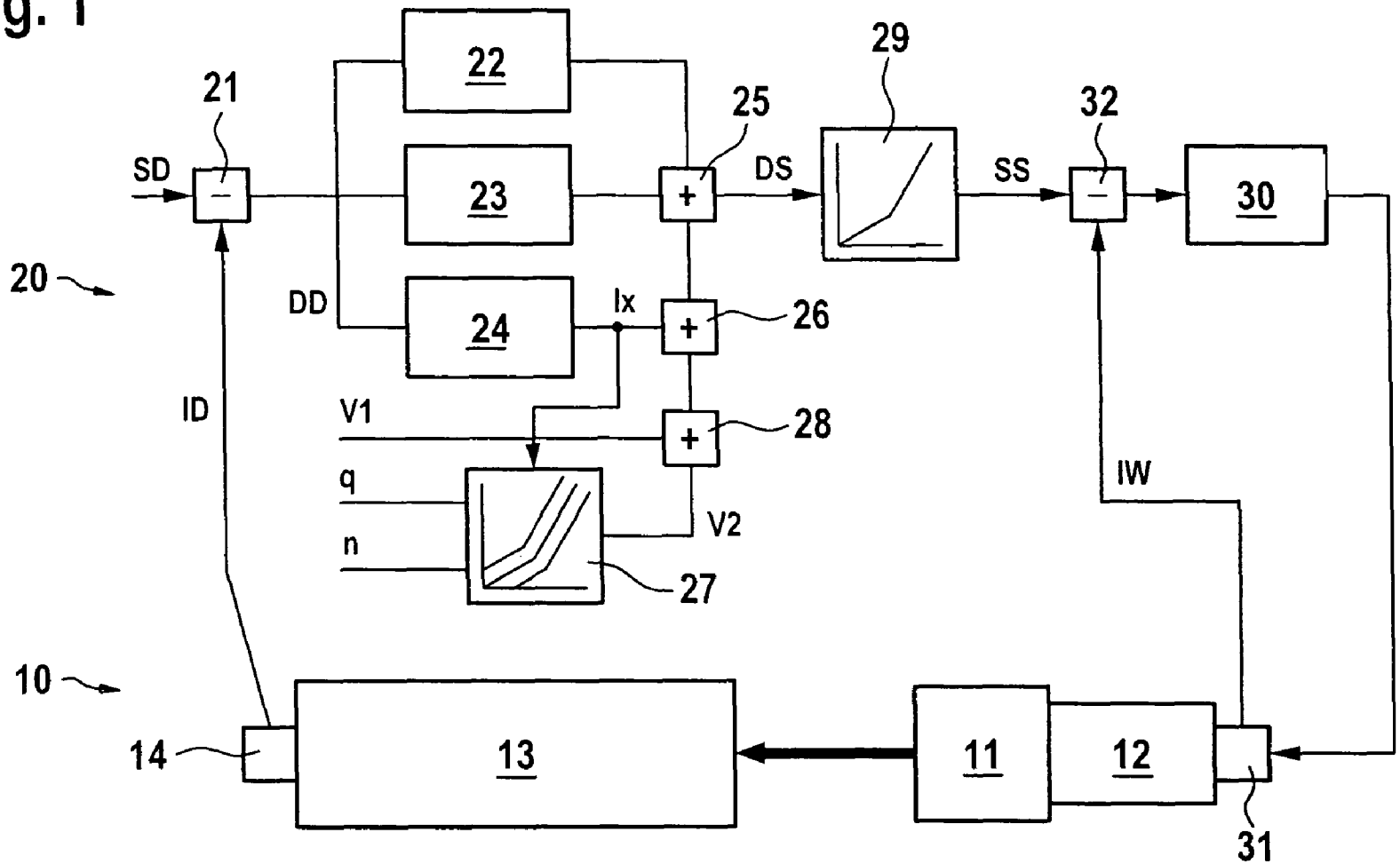
FIG. 1 shows a schematic block diagram of an exemplary embodiment of a method according to the present invention for operating a fuel injection system.

FIG. 1 shows a fuel injection system 10 of an internal combustion engine. Fuel injection system 10 is a high-pressure fuel injection system in particular, and the engine is a diesel engine for a motor vehicle in particular.

Fuel injection system 10 has a pump 11, a high-pressure pump in particular, which receives the fuel via a metering unit 12. The discharge side of pump 11 is connected to a fuel accumulator 13, in which the fuel is stored under pressure. Fuel accumulator 13 is connected, in a way not shown, to injectors through which the fuel is injected into the combustion chambers of the engine. Furthermore, a pressure sensor 14 which measures the pressure in fuel accumulator 13 is associated with fuel accumulator 13.

Fuel injection system 10 is controlled and/or regulated by a control unit not depicted in detail. For this purpose, the control unit has a computer having an electric memory medium, a flash memory in particular. A computer program capable of running on the computer is stored on the memory medium. This computer program is suitable for influencing fuel injection system 10 and thus for performing the desired control and/or regulation.

In addition to fuel injection system 10, FIG. 1 also shows a method 20 for operating this fuel injection system 10 in the form of a block diagram. This method 20 is carried out by the control unit. Optionally parts of method 20 may also be implemented with the aid of analog electronic modules.

A signal corresponding to actual pressure ID in fuel accumulator 13 is generated by pressure sensor 14 and supplied to a comparator 21, where actual pressure ID is compared to a setpoint pressure SD. Pressure difference DD is relayed to three regulators: a P regulator 22 (proportional regulator), a D regulator 23 (differential regulator) and an I regulator 24 (integral regulator). The outputs of these three regulators are added by an adder 25 to form a control value DS for a desired fuel throughput. This desired fuel throughput is then supplied by metering unit 12 to pump 11 and thus to fuel accumulator 13.

A precontrol signal V1 is also provided, which is added to control value DS by an adder 26.

According to the present invention, precontrol characteristic map 27 is also provided, whose output-side precontrol signal V2 is added to control value DS for the fuel throughput by an adder 28. Instantaneous injection quantity q and instantaneous engine speed n are supplied to precontrol characteristic map 27 as input signals.

Control value DS for the desired fuel throughput is supplied to a characteristic curve 29, which represents metering unit 12. With the help of this characteristic curve 29, control value SS for a current via which metering unit 12 must be triggered to produce the desired fuel throughput is ascertained from control value DS.

This control value SS represents a setpoint value for a downstream current regulator 30. Metering unit 12 then receives the current corresponding to control value SS from current regulator 30. The current actually flowing across metering unit 12 is measured by a sensor 31 and supplied as actual value IW to a comparator 32, where actual value IW is subtracted from control value SS. The difference is then supplied to current regulator 30.

In method 20 depicted in FIG. 1, actual pressure ID present in fuel accumulator 13 is then regulated to setpoint pressure SD. For this purpose, the three regulators 22, 23, 24 and precontrol signal V1 are provided among other things. Metering unit 12 is then influenced as a function of resulting control value DS for the desired fuel throughput. The current supplied to metering unit 12 is regulated by current regulator 30.

In the case of high-pressure fuel injection systems in particular, the metering units of different fuel injection systems are subject to manufacturing-related variance. This means that the metering unit of a first fuel injection system has a different efficiency and thus characteristic curve than those of the metering unit of a second fuel injection system. A similar reasoning applies to the pumps and fuel accumulators of different fuel injection systems. This may result in substantial differences regarding the metering of fuel by the different fuel injection systems.

According to the present invention these manufacturing-related differences in the components of fuel injection system 10 are taken into account by precontrol characteristic map 27 and precontrol signal V2 resulting therefrom. As explained below, adaptive precontrol is achieved with the aid of precontrol characteristic map 27 in particular.

In a recently manufactured fuel injection system 10, precontrol characteristic map 27 contains no values. Only the value zero may be read from precontrol characteristic map 27. Therefore, at this time, precontrol characteristic map 27 has no influence on method 20 for operating fuel injection system 10.

Precontrol characteristic map 27 is filled with values one by one during operation of fuel injection system 10. For this purpose, it is determined whether fuel injection system 10 is at a steady-state operating point at the moment. If this is the case, the output value of I regulator 24 corresponding to this operating point is processed further as described above, in addition to the above-explained method 20. This output value of I regulator 24, dependent on the operating point, is labeled with the reference symbol Ix in FIG. 1.

Figure 2:
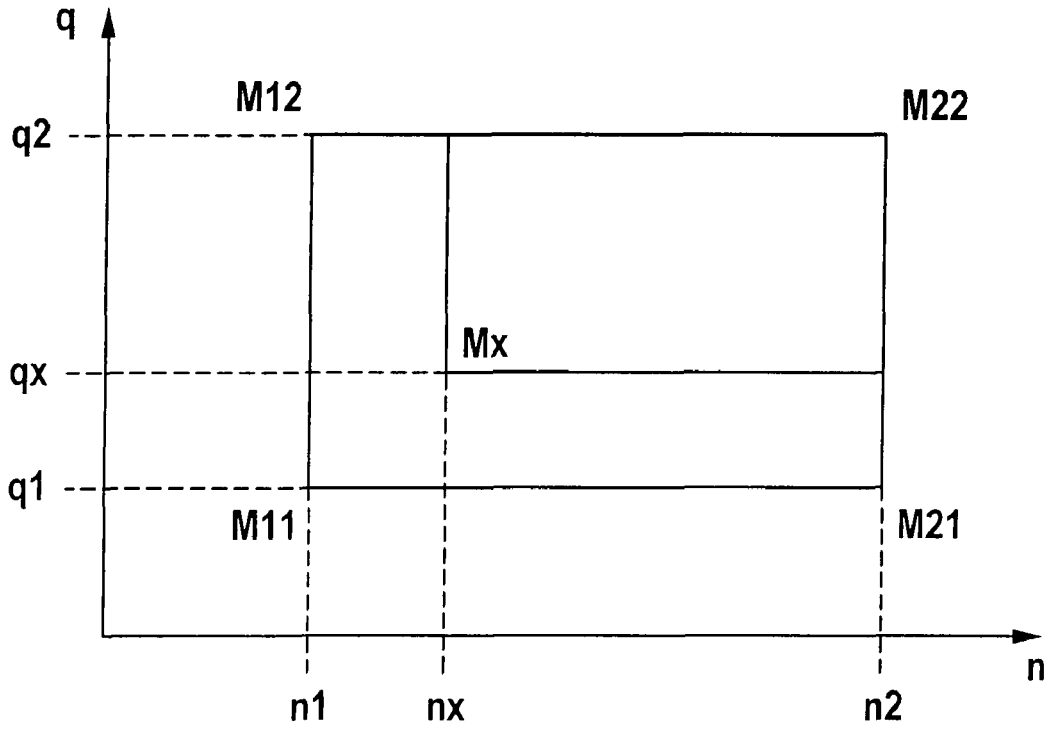
FIG. 2 shows a detail of a precontrol characteristic map used in the method of FIG. 1.

FIG. 2 shows a detail of precontrol characteristic map 27 of FIG. 1. On the two axes of this precontrol characteristic map 27, the injected quantity q is plotted against engine speed n.

Four sampling points of precontrol characteristic map 27 are labeled M11, M12, M21, M22 in FIG. 2. First sampling point M11 refers to an injection quantity q1 at an engine speed n1; second sampling point M12 refers to an injection quantity q2 at an engine speed n1; third sampling point M21 refers to an injection quantity q1 at an engine speed n2, and fourth sampling point M22 refers to an injection quantity q2 at an engine speed n2.

Furthermore, the detail of FIG. 2 shows instantaneous steady-state operating point Mx of fuel injection system 10. This operating point is defined by instantaneous injection amount qx and instantaneous engine speed nx. Instantaneous operating point Mx is situated within the quadrangle enclosed by four sampling points M11, M12, M21, M22 and thus in the vicinity of all four sampling points M11, M12, M21, M22.

Instantaneous operating point Mx of fuel injection system 10 thus does not coincide with any of sampling points M11, M12, M21, M22 of precontrol characteristic map 27. Output value Ix of I regulator 24, associated with this operating point Mx, is therefore distributed to the four sampling points M11, M12, M21, M22. This is performed for each of sampling points M11, M12, M21, M22 using the following equations:

$$M11,\text{new}=M11,\text{old}+Ix*(n2-nx)^{2}*(q2-qx)^{2}$$

$$M12,\text{new}=M12,\text{old}+Ix*(n2-nx)^{2}*(q1-qx)^{2}$$

$$M21,\text{new}=M21,\text{old}+Ix*(n1-nx)^{2}*(q2-qx)^{2}$$

$$M22,\text{new}=M22,\text{old}+Ix*(n1-nx)^{2}*(q1-qx)^{2}.$$

The closest sampling point is more strongly affected than the other three sampling points by these equations. If instantaneous operating point Mx falls on one of sampling points M11, M12, M21, M22, the corresponding output value Ix of I regulator 24 is taken into account only for this sampling point, but not for the other three sampling points.

Of course, other equations may also be provided for calculating the values at the sampling points. In particular, a differently weighted distribution of output value Ix of I regulator 24 over more than four sampling points of precontrol characteristic map 27 may also be possible.

In this way, output values of I regulator 24 at the sampling points are stored one by one during operation of fuel injection system 10 in precontrol characteristic map 27 for a plurality of additional operating points. This represents a "learning" process of precontrol characteristic map 27 during operation of fuel injection system 10.

At the same time, during operation of fuel injection system 10, the values stored in precontrol characteristic map 27 are read out and used as precontrol values V2 in method 20 of FIG. 1.

When reading from precontrol characteristic map 27, the sampling points are taken into account again, but in an inverse procedure. The sampling points situated next to one another at the instantaneous operating point are ascertained. The values stored for these four sampling points are then read from precontrol characteristic map 27. These four values are linked to precontrol value V2 via a predefined function, preferably via linear interpolation. The position of the instantaneous operating point with respect to the four adjacent sampling points is taken into account in this interpolation.

Thus, if the output of I regulator 24 has an output value Ix for a certain operating point qx/nx, i.e., for a certain injected quantity qx at a certain engine speed nx, this output value Ix is transferred to precontrol characteristic map 27. If fuel injection system 10 assumes this operating point qx/nx again at a later point in time, precontrol characteristic map 27 immediately delivers precontrol value V2 in which corresponding output value Ix is taken into account.

I regulator 24 delivers an output value Ix just when one or more components of fuel injection system 10 have manufacturing-related variances. For example, if metering unit 12 has an actual characteristic curve which differs from intended characteristic curve 29 of metering unit 12 due to manufacturing-related variances, this difference is compensated by I regulator 24 via an appropriate output value Ix. Due to the transfer of such output values into precontrol characteristic map 27 as explained above, all differences in the characteristic curve of metering unit 12 are no longer compensated individually by I regulator 24, but via precontrol value V2 of precontrol characteristic map 27.

The advantage of this procedure is, among other things, that precontrol values V2 may be read from precontrol characteristic map 27 in considerably less time than it would take for I regulator 24 to generate an appropriate output value. This is a result of the intrinsic inertia of I regulator 24, with which it always approximates its output value via a time constant. Due to precontrol characteristic map 27, I regulator 24 no longer needs to deliver an output signal at least with regard to the manufacturing-related differences in the components of fuel injection system 10.

In the event of a change between two operating points, a manufacturing-related difference in the components of fuel injection system 10 is taken into account considerably more rapidly due to precontrol characteristic map 27 of the present invention than would be possible using I regulator 24 alone. The accuracy of fuel injection is therefore increased due to method 20 according to the present invention for operating fuel injection system 10.

Furthermore, due to the continuous "learning" process of precontrol characteristic map 27 during the entire service life of fuel injection system 10, a possible drift of fuel injection system 10 is also compensated. This represents a further improvement in the accuracy of the fuel injection.

What is claimed is:

1. A method for operating a fuel injection system of a motor vehicle, the fuel injection system having a fuel accumulator capable of receiving fuel via a metering unit, the method comprising:

influencing an actual pressure in the fuel accumulator by an I regulator;

ascertaining values for a precontrol characteristic map in an operation of the fuel injection system one by one and entering the ascertained values in the precontrol characteristic map, wherein at an operating point of the fuel injection system, an output value of the I regulator is entered in the precontrol characteristic map;

generating a precontrol value by the precontrol characteristic map; and using the precontrol characteristic map for compensating manufacturing-related differences in the components of the fuel injection system.

2. The method as recited in claim 1, further comprising:

distributing the output value of the I regulator to a plurality of sampling points of the precontrol characteristic map.

3. The method as recited in claim 1, further comprising:

predefining the operating point of the fuel injection system by an injection quantity at an engine speed.

4. The method as recited in claim 1, wherein the precontrol value is generated from the precontrol characteristic map in an operation of the fuel injection system for an instantaneous operating point of the fuel injection system.

5. The method as recited in claim 4, wherein the actual pressure in the fuel accumulator is affected by the precontrol value read from the precontrol characteristic map.

6. The method as recited in claim 1, further comprising:

performing an adaptive precontrol with the aid of the precontrol characteristic map.

7. A non-transitory, computer-readable data storage medium storing a computer program having program codes which, when executed on a computer, performs a method for operating a fuel injection system of a motor vehicle, the fuel injection system having a fuel accumulator capable of receiving fuel via a metering unit, the method comprising:

influencing an actual pressure in the fuel accumulator by an I regulator;

ascertaining values for a precontrol characteristic map in an operation of the fuel injection system one by one and entering the ascertained values in the precontrol characteristic map, wherein at an operating point of the fuel injection system, an output value of the I regulator is entered in the precontrol characteristic map;

generating a precontrol value by the precontrol characteristic map; and using the precontrol characteristic map for compensating manufacturing-related differences in the components of the fuel injection system that when executed.

8. A control unit for a fuel injection system of a motor vehicle, the fuel injection system having a fuel accumulator capable of receiving fuel via a metering unit, the control unit comprising:

an I regulator for influencing an actual pressure in the fuel accumulator; and a precontrol characteristic map configured to generate a precontrol value output, wherein values for the precontrol characteristic map are ascertained in an operation of the fuel injection system one by one and entered in the precontrol characteristic map, and wherein at an operating point of the fuel injection system, an output value of the I regulator is entered in the precontrol characteristic map, and wherein the precontrol characteristic map is used for compensating manufacturing-related differences in the components of the fuel injection system, of a motor vehicle.

9. A fuel injection system for a motor vehicle, comprising:

a fuel accumulator capable of receiving fuel via a metering unit; and a control unit including:

an I regulator for influencing an actual pressure in the fuel accumulator; and a precontrol characteristic map configured to generate a precontrol value output, wherein values for the precontrol characteristic map are ascertained in an operation of the fuel injection system one by one and entered in the precontrol characteristic map, and wherein at an operating point of the fuel injection system, an output value of the I regulator is entered in the precontrol characteristic map, and wherein the precontrol characteristic map is used for compensating manufacturing-related differences in the components of the fuel injection system, of a motor vehicle.

* * * * *